United States Patent [19]

Lee et al.

[11] Patent Number: 4,710,239

[45] Date of Patent: Dec. 1, 1987

[54] HOT PRESSED PERMANENT MAGNET HAVING HIGH AND LOW COERCIVITY REGIONS

[75] Inventors: Robert W. Lee, Troy, Mich.; Neal A. Schaffel, Noblesville, Ind.

[73] Assignee: General Motors Corporation, Detroit, Mich.

[21] Appl. No.: 897,591

[22] Filed: Aug. 18, 1986

Related U.S. Application Data

[62] Division of Ser. No. 650,623, Sep. 14, 1984, abandoned.

[51] Int. Cl.[4] ..... H01F 1/02

[52] U.S. Cl. ..... 148/101; 148/104; 419/12

[58] Field of Search ..... 148/101, 104; 419/12, 419/30, 48, 49, 50

[56] References Cited

U.S. PATENT DOCUMENTS

| | | | |
|---|---|---|---|
| 3,482,156 | 12/1969 | Porath | 310/156 |
| 3,887,395 | 6/1975 | Martin | 148/103 |
| 4,074,274 | 3/1978 | Richmond | 310/51 |
| 4,110,718 | 8/1978 | Odor et al. | 335/296 |
| 4,222,021 | 9/1980 | Bunker | 335/296 |
| 4,243,902 | 1/1981 | Ban et al. | 310/154 |

FOREIGN PATENT DOCUMENTS

| | | | |
|---|---|---|---|
| 55-15223 | 2/1980 | Japan | 148/104 |
| 56-47538 | 4/1981 | Japan . | |
| 58-123853 | 7/1983 | Japan . | |
| 58-153306 | 9/1983 | Japan | 148/104 |
| 918910 | 2/1963 | United Kingdom | 148/104 |
| 2057194 | 3/1981 | United Kingdom . | |

OTHER PUBLICATIONS

Croat et al., "High-Energy Product Nd-Fe-B Permanent Magnets", *Appl. Phys. Lett.*, 44(1), Jan. 1, 1984, pp. 148-149.

Hadjipanayis et al., "New Iron-Race-Earth Based Permanent Magnet Materials", *Appl. Phys. Lett.*, 43(8), Oct. 15, 1983, pp. 797-799.

Kabacuff et al., "Thermal and Magnetic Properties of Amorphous $Pr_x(Fe_{0.8}\ B_{0.2})_{1-x}$", *J. of Applied Phys.*, 53(3), Mar. 1982, pp. 2255-2257.

Stadelmaier et al., "Cobalt-Free and Samarium-Free Permanent Magnets Materials, Based on an Iron-Rare Earth Boride; *Mat. Lett.*, vol. 2, No. 2, Oct. 1983, pp. 169-172.

*Primary Examiner*—John P. Sheehan

*Attorney, Agent, or Firm*—George A. Grove

[57] ABSTRACT

In accordance with a preferred embodiment, an arcuate magnet is formed by selectively hot working a composition including iron, neodymium and/or praseodymium, and boron such that an edge of the arcuate has greater apparent coercivity than a central region and the central region has a higher remanence than the edge.

5 Claims, 12 Drawing Figures

HOT PRESSED PERMANENT MAGNET HAVING HIGH AND LOW COERCIVITY REGIONS

This is a division of application Ser. No. 650,623 filed on Sept. 14, 1984 abandoned.

This invention relates to hot worked unitary permanent magnets having at least two separate regions of different magnetic alignment. More particularly, this invention relates to iron, neodymium and/or praseodymium, and boron containing permanent magnet bodies that have been hot worked so as to contain distinct regions of different alignment—e.g., one of relatively high apparent coercivity and one of relatively high remanence.

BACKGROUND

High energy product, high coercivity permanent magnet compositions comprising, for example, iron, neodymium and/or praseodymium, and boron and methods of making them are disclosed in U.S. Ser. No. 414,926 filed Sept. 3, 1982, Ser. No. 508,266 filed June 24, 1983 and U.S. Ser. No. 544,728 filed Oct. 26, 1983, all by John J. Croat and assigned to the assignee of this application. An illustrative composition, expressed in atomic proportions, is $Nd_{0.13}(Fe_{0.95}B_{0.05})_{0.87}$. It is a composition containing a specific stable intermetallic phase and that possesses high coercivity when formed as fine crystallites about 20 to 40 nanometers in largest dimension.

Melts of suitable iron-light rare earth metal-boron compositions can be very rapidly quenched, such as by melt spinning, to produce a solid material, e.g., a thin ribbon. When the rate of cooling has been controlled to produce a suitable fine crystalline microstructure (20 nm to 400 nm), the material has excellent permanent magnet properties. On the other hand, faster cooling (overquenching) produces a material with smaller crystallites and lower coercivity. However, as disclosed, such overquenched material can be annealed to form the suitable crystal size with the associated high coercivity and high energy product.

An interesting and useful property of this neodymium-iron-boron composition (for example) is that it is substantially magnetically isotropic. A fine grain, melt spun ribbon can be broken up into flat particles. The particles can be pressed in a die at room temperature to form a unitary body of about 85% of the material's density. Bonding agents can be employed before or after the compaction. The making of such bonded magnets is disclosed in U.S. Ser. No. 492,629 filed May 9, 1983 by Robert W. Lee and John J. Croat and assigned to the assignee hereof. It was surprising to find that such bonded magnets displayed no preferred magnetic direction. Values of intrinsic coercivity or maximum energy product were not dependent upon the direction of the applied magnetic field. There was no advantage in grinding the ribbon to very fine particles and magnetically aligning the particles before compaction.

Such magnetically isotropic materials are very useful because they can be easily pressed (without magnetic alignment) into bonded shapes. The shapes can be magnetized in the most convenient direction.

The iron, neodymium, boron type compositions have also been processed by hot pressing and hot working so that at least a portion of the grains or crystallites was physically aligned producing at least partial magnetic alignment. As disclosed in U.S. Ser. No. 520,170 filed Aug. 4, 1983 by Robert W. Lee, such hot worked materials had a preferred direction of magnetization. In one form of the practice disclosed in that application, a molten material containing, in terms of atomic proportions, $Nd_{0.13}(Fe_{0.95}B_{0.05})_{0.87}$ is cooled extremely rapidly, as by melt spinning, to form a thin ribbon of solid material that did not have permanent magnet properties. The material was amorphous in microstructure. The ribbon was broken into particles of convenient size for a hot working operation. The particles were heated under argon to about 700° C. or higher in a die and pressed with punches in the die under pressure of at least 10,000 psi. Such hot working, hereafter termed hot pressing, consolidated the particles into a fully dense body.

If the hot working is stopped at the point at which the material is consolidated to full density, the result is a slightly magnetically aligned magnet with the easy magnetization direction parallel to the press direction. The demagnetization curve (room temperature, second quadrant, $4\pi M$ versus H plot) of such a densified magnet is like that of curve A in FIG. 1.

When the fully dense compact is repressed under like conditions of elevated temperature and pressure in a larger die cavity, the compact undergoes considerable plastic strain in the plane perpendicular to the press direction. This second stage of hot working is termed die upsetting, and it produces substantial magnetic alignment with the easy direction of magnetization transverse to the plastic strain direction. The demagnetization curve for such a die upset body is like that of curve B in FIG. 1. Examination of the demagnetization curves of FIG. 1 shows that the hot pressed magnet (curve A) and the die upset maqnet (curve B) have substantially different degrees of magnetic alignment. The hot pressed magnet has relatively higher coercivity and lower remanence in the press direction than the die upset magnet. The die upset magnet has a higher maximum energy product, but it is easier to demagnetize than the hot pressed body of the same composition. There are applications for magnets in which it is desirable to incorporate both characteristics in a unitary magnet body.

It is an object of the present invention to provide a method of hot working a permanent magnet body to produce at least two regions spaced along a surface dimension of the body and having different desired magnetic alignments. Generally speaking, one of the regions will have higher apparent coercivity but lower remanence than the other region. We particularly contemplate application of the method to rapidly cooled compositions comprising iron, neodymium and/or praseodymium and boron.

It is another object of our invention to provide a unitary magnetic structure that has been selectively hot worked such that it contains separate regions of differing magnetic alignment. An example of such a magnetic structure is an arcuate magnet for a permanent magnet motor. It is contemplated that one or both of the circumferential edges of the arc would be worked so as to have relatively high coercivity and the central portion of the arc would have a relatively higher remanence. Again, we especially contemplate that the magnet would be of the above described iron-light rare earth metal boron compositions.

BRIEF SUMMARY

In accordance with a preferred embodiment of our invention, these and other objects and advantages are accomplished as follows.

The starting material is a rapidly quenched composition comprising iron, neodymium and/or praseodymium, and boron. An example of a suitable composition is one consisting, in terms of atomic proportion, of $Nd_{0.13}(Fe_{0.95}B_{0.05})_{0.87}$. The starting material is amorphous in microstructure or characterized by an extremely fine crystalline structure. It is preferred to start with such an amorphous or fine grained microstructure so that the hot working can be carried out without loss of suitable coercivity in the final product.

Particles of melt spun material are placed in the cavity of an open-ended die between two opposing punches. The particles are heated in the die to a temperature, suitably about 700° C. or higher, and compacted at a suitable pressure to form a fully densified body. Split-ram punches may be employed, as will be described, such that the consolidated body has a stepwise variation in thickness over its cross section within the die. While still in the hot die, the respective punch edges (of the split ram) may then be brought into alignment and moved in concert to subject a portion of the consolidated part to further hot working. Such hot working strains the thick portion of the irregular consolidated part differently than the thin portion. The different strain over the cross section produces two regions of generally different magnetic alignment. The region that is most highly strained in the direction perpendicular to the press direction is more highly aligned and has a demagnetization curve like that of curve B in FIG. 1. The region that was not deformed (or less deformed) by the second press operation has less magnetic alignment and displays magnetic properties like that of curve A in FIG. 1.

This generally illustrates one practice of hot working different regions of an iron, neodymium and/or praseodymium, and boron composition such that a unitary body is formed having regions intentionally produced of different magnetic alignment. A typical application for our practice is an arcuate motor magnet in which the leading edge of the arcuate magnet (in a motor that rotates in one direction only) is subjected to a higher demagnetization force than the rest of the arc. In such application the leading edge of the arc would be processed so as to have high apparent coercivity (measured radially with respect to the arc) and the rest of the arc would be hot worked so as to have relatively high remanence and maximum energy product.

A better understanding of our invention will be gained from a detailed description thereof as follows. Reference will be had to the drawings in which:

DETAILED DESCRIPTION

Figure 1:
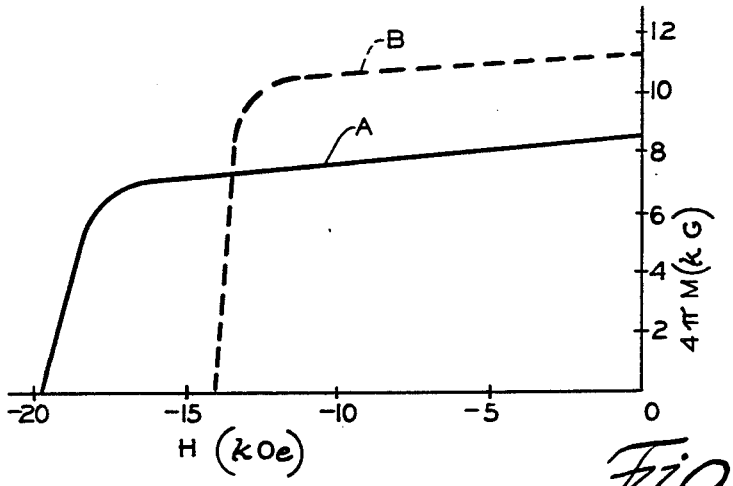
FIG. 1 is a second quadrant, room temperature, 4 M versus H plot of a hot pressed magnet (curve A) and a die upset magnet (curve B)

Our invention is applicable to permanent magnet compositions that can be magnetically aligned by plastic deformation of the material at elevated temperatures. An example of a family of preferred compositions to which our method is applicable is the transition metal-rare earth metal-boron materials described in the above-identified patent applications. Our practice is particularly applicable to compositions in which the transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth elements, such as samarium, lanthanum, cerium, terbium and dysprosium, may be mixed with neodymium and praseodymium without substantial loss of the desirable magnetic properties. Preferably, they make up no more than about 40 atomic percent of the rare earth component. It is expected that there will be small amounts of impurity elements with the rare earth component.

The overquenched composition contains about 1 to 10 atomic percent boron.

The overall composition may be expressed by the formula $RE_{1-x}(TM_{1-y}B_y)_x$. The rare earth (RE) component makes up to 10 to 50 atomic percent of the composition ($x=0.5$ to 0.9), with at least 60 atomic percent of the rare earth component being neodymium and/or praseodymium. The transition metal (TM) as used herein makes up about 50 to 90 atomic percent of the overall composition, with iron representing at least about 60 atomic percent of the transition metal content. The other constituents, such as cobalt, nickel, chromium and manganese, are called "transition metals" insofar as the above empirical formula is concerned.

Boron is present in an amount of about 1 to 10 atomic percent ($y=$about 0.01 to 0.11) of the total composition.

For convenience, the compositions have been expressed in terms of atomic proportions. Obviously these specifications can be readily converted to weight proportions for preparing the composition mixtures.

For purposes of illustration, our invention will be described using compositions of approximately the following atomic proportions:

$$Nd_{0.13}(Fe_{0.95}B_{0.05})_{0.87}$$

However, it is to be understood that our method is applicable to other compositions as described above. Depending on the rate of cooling, molten transition metal-rare earth-boron compositions can be solidified to have microstructures ranging from:

(a) amorphous (glassy) and extremely fine grained microstructures (e.g., less than 20 nanometers in largest dimension) through (b) very fine (micro) grained microstructures (e.g., 20 nm to about 400 nm) to (c) larger grained microstructures.

Thus far, large grained microstructure materials with useful permanent magnet properties have not been produced by rapid solidification from a melt. Fine grain microstructures, where the grains have a maximum dimension of about 20 to 400 nanometers, have useful permanent magnet properties. Amorphous materials do not. However, some of the glassy microstructure materials can be annealed to convert them to fine grain permanent magnets having isotropic magnetic properties. Our invention is particularly applicable to such overquenched, glassy materials. It is also applicable to "as-quenched" high coercivity, fine grain materials provided the materials are exposed only for short times, e.g., less than five minutes, at high temperatures, over 700° C., during the hot working.

Suitable overquenched compositions can be made by melt spinning. Melt spinning is described in the above applications and will not be repeated here. It is also practiced commercially to produce nonmagnetic or soft magnetic alloys. We prefer to use melt spun materials that have been cooled at a rate such that an amorphous or extremely fine crystal structure is produced. In the case of the iron-neodymium-boron compositions, we prefer to start with a rapidly solidified structure having a grain size smaller than about 20 nanometers. We then heat and work the material in a die at a temperature of about 700°–750° C. to consolidate particles of the material into a fully densified mass and then to selectively deform the consolidated material plastically to achieve regions of different magnetic alignment. Such processing is carried out fairly rapidly so that excessive grain growth does not occur and the permanent magnet characteristics lost.

Reference has already been made to FIG. 1 which graphically depicts the demagnetization properties of a hot pressed iron-neodymium-boron magnet (curve A) and a die upset magnet (curve B) of the same composition. The hot pressed magnet is only moderately magnetically aligned and possesses a relatively high degree of coercivity in the press direction. The die upset magnet has been significantly plastically deformed. The material has attained a relatively high degree of alignment. Its coercivity in the press direction has thereby been decreased but its remanence increased.

In our work we have observed that our hot worked magnets display magnetic alignment in a direction perpendicular to the direction of plastic flow. When such plastic flow happens to be perpendicular to the press direction (the direction of movement of the punches), the magnetic alignment is parallel to the press direction. When we measure magnetic properties, e.g., coercivity and remanence, of such anisotropic magnets, we detect and report the values measured in the preferred (aligned) direction unless otherwise stated.

Figure 2A:
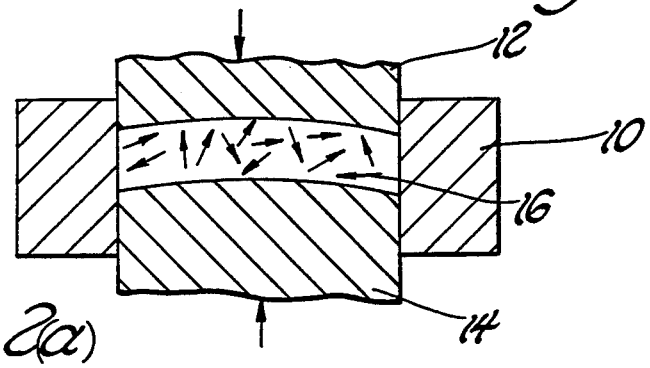
FIGS. 2(*a*)-(*c*) are schematic drawings, partly in section, of two different die sets showing a sequence of die operations for forming a hot worked arcuate magnet.
Figure 2B:
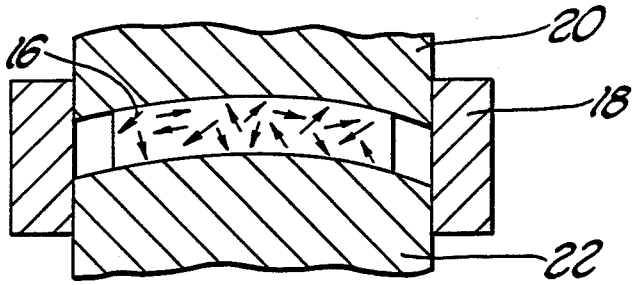
Figure 2C:
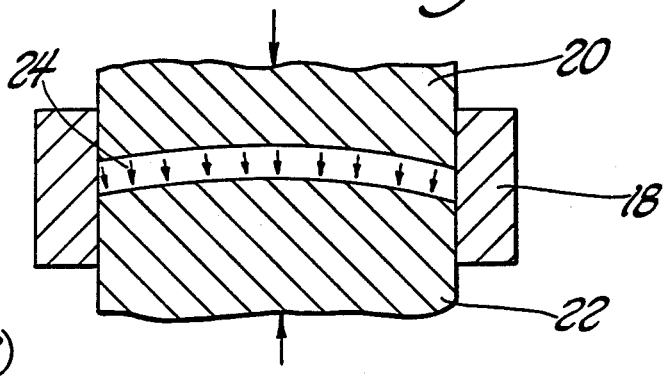

Reference is made to FIG. 2 to illustrate the method of forming a die upset magnetically aligned arcuate permanent magnet. Particles of melt spun material are loaded into the cavity formed by open ended die 10 and vertically aligned opposing punches 12 and 14 such as is shown in FIG. 2(*a*). The die and its contacts are heated by an induction heater (not shown) to a temperature at or near 700° C. The punches 12 and 14 compact the particulate material under a pressure of, for example, 15,000 psi to form the substantially fully densified body 16 depicted in the die cavity in FIG. 2(*a*). The arrows within the outline of body 16 indicate that the densified compact is substantially unaligned. However, there is a slight alignment preference in the direction of compaction. The magnetic properties of this compact are like that depicted in curve A of FIG. 1.

The compact 16 is then transferred to a larger die 18 with opposing punches 20 and 22 as shown in FIG. 2(*b*). The cavity is likewise heated to maintain the compact 16 at a temperature at or near 700° C. The compact 16 is then plastically deformed by the punches 20 and 22 to form die upset arcuate body 24. The material flows laterally, but the direction of alignment, and easy magnetization, is transverse to the plastic flow, i.e., generally in the direction of pressing as shown by the arrows in FIG. 2(*c*). The resulting arcuate magnet 24 is wider and thinner than compact 16. Magnet 24 has a high degree of magnetic alignment which is substantially uniformly radial with respect to the center of curvature. Magnet 24 is shown in section in FIG. 2(*c*). In perspective view it would appear like the magnet 36 shown in FIG. 4(*b*). Such arcuate magnet 24 could be produced by the practice described in the above cited Lee application.

Figure 3A:
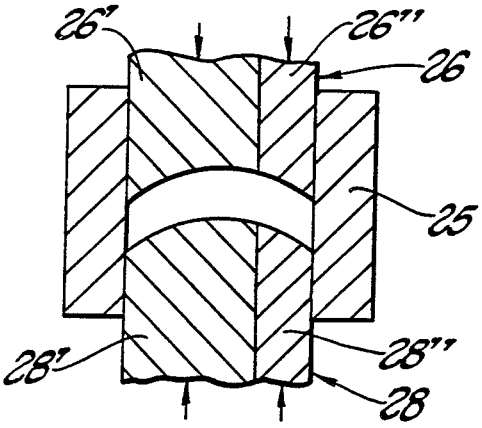
FIGS. 3(*a*) and (*b*) are schematic representations, partly in section, showing a split-ram die in two different modes of operation.
Figure 3B:
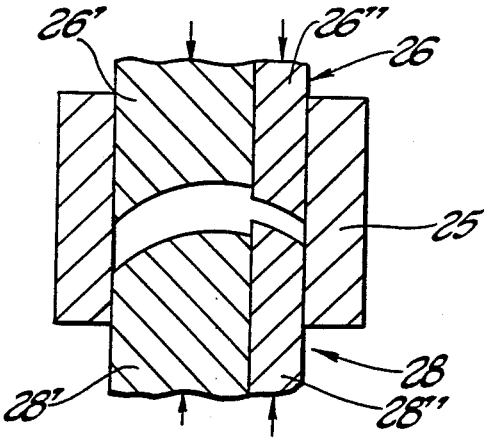

In accordance with our invention, we provide an arcuate magnet or other permanent magnet structure in which there are at least two regions in the unitary body having different magnetic alignment. In one embodiment of our invention, this is accomplished by first making a densified hot pressed compact having sections of different thickness. A convenient practice is to form a compact having abrupt or stepped differences in thickness. This can be accomplished by using a split ram die as depicted in FIG. 3. As shown, such a die uses a conventional die body 25, but both the upper 26 and lower 28 punches are split and the two portions (26', 26'' and 28', 28'') of each punch can either move in concert as shown in FIG. 3(*a*) or move separately as shown in FIG. 3(*b*). Such a split punch or split ram die arrangement can be employed to hot press and consolidate particulate melt spun material to form a compact like that depicted in FIG. 4(*a*).

Figure 4A:
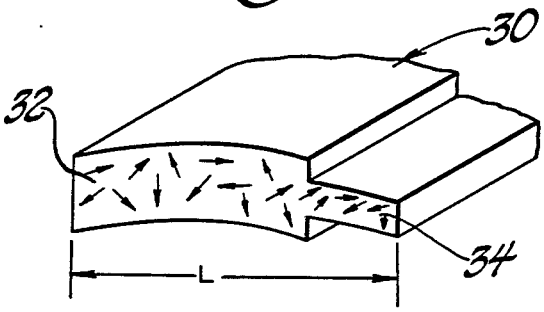
FIGS. 4(*a*) and (*b*) are schematic cross sections of a hot pressed compact and a die upset permanent magnet processed in accordance with the subject invention.
Figure 4B:
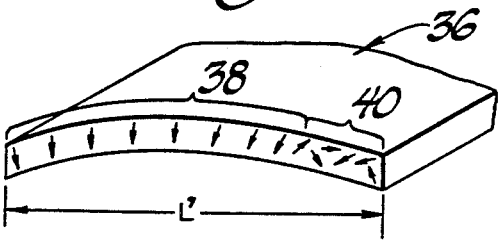

The arcuate hot pressed compact 30 of FIG. 4(*a*) is of substantially uniform density and random magnetic alignment (or disalignment), but it has a stepwise change in thickness. The perspective view (FIG. 4(*a*)) of arcuate compact 30 shows a relatively thick portion 32 and adjacent thin section 34. The compact 30 has a chord length L. It can be produced in a split ram die in which the split punches are operated as shown in FIG. 3(*b*). The formation of a hot pressed, densified compact 30 of such configuration permits the making of a die upset arcuate of uniform thickness but having regions of different magnetic alignment. The compact of FIG. 4(*a*) is pressed in a wider section die cavity, heated to a temperature of about 700° C. and hot worked into a longer (chord length L'>L as seen in FIG. 4) but thinner arcuate magnet 36 such as depicted in FIG. 4(*b*). Since section 32 of the FIG. 4(*a*) compact 30 was thicker than section 34, it undergoes more plastic deformation and flow. Therefore, this portion 32 of compact 30 undergoes considerable lateral strain to form arcuate region 38 of die upset magnet 36 in FIG. 4(*b*). Thus, region 38 of the final arcuate magnet 36 is highly magnetically aligned as illustrated in FIG. 4(*b*). Conversely, region 34 of compact 30 undergoes relatively little deformation and thus region 40 of magnet 36 is substantially unaligned. Region 40 has magnetization characteristics like that of curve A of FIG. 1, and region 38 has magnetic characteristics like that of curve B. Thus, the right circumferential edge portion 40, as seen in FIG. 4(*b*), of the arcuate magnet 36 has a higher coercivity than the rest of the one-piece magnet. This characteristic is particularly useful in arcuate pole pieces of a DC motor where the demagnetization forces act most severely on the leading edge of the magnet.

Figure 5:
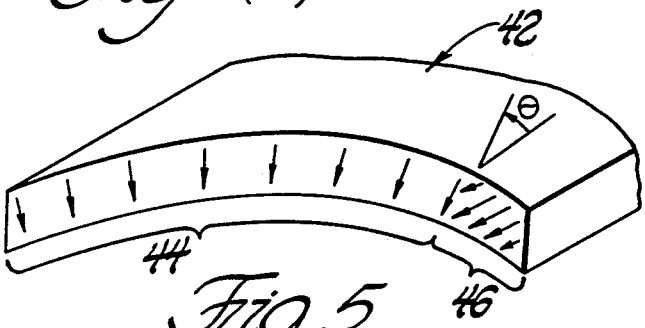
FIG. 5 illustrates in cross section a hot worked arcuate magnet containing adjacent regions of different magnetic alignment in accordance with the subject invention.

FIG. 5 is an end view of a two-region magnet 42 illustrating a general principle of our invention. One (or both) arcuate edge (region 46) of magnet 42 has a magnetic orientation as schematically illustrated by the direction of the arrows of the Figure that are oriented at an angle theta ($\theta \neq 0$) with respect to the radial direction of the arc. The remaining portion 44 of the magnet has been worked such that it is magnetically oriented radially with respect to the center of curvature, as shown by the arrows in region 44. Thus, both regions 44 and 46 are highly aligned and have relatively high remanence in the alignment direction. However, edge region 46 is more difficult to demagnetize by the reverse field generated by a motor armature. Such two-part magnet is another embodiment of our invention. A two-part magnet like that depicted in FIG. 5 can be produced by a practice illustrated in FIGS. 6(*a*) and (*b*). A die upset permanent magnet 48 of the warped configuration depicted in FIG. 6(*a*) is produced. A hot pressed compact is first made and then die upset into the FIG. 6(*a*) configuration with strain occurring in the direction indicated. Although the die upset magnet 48 is warped, the magnetic orientation is parallel across the entire end section. While still warm, the warped body 48 is bent in a die 50 between opposed punches 52 and 54 into an arcuate permanent magnet like 42 in FIG. 5. The reversed bending of the warped starting magnet produces an arcuate magnet (like 42) having regions (like 44 and 46) of different magnetic alignment as illustrated in FIG. 5.

Figure 7:
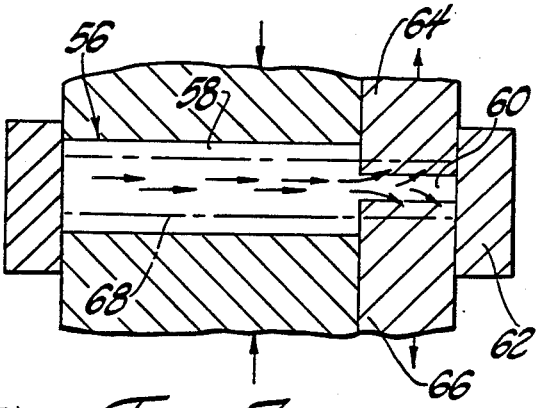
FIG. 7 illustrates yet another die forming practice of forming a permanent magnet having at least two regions of different magnetic alignment.

FIG. 7 illustrates yet another die forming practice of producing a two-part permanent magnet in accordance with our invention. A hot-pressed uncurved compact 56 of stepwise difference in thickness is first produced. The compact 56 has a relatively thick portion 58 and a thin portion 60. This is accomplished in die 62 using split punches 64 and 66 operated in stepped relationship. The punches are then slightly withdrawn and employed in concert to produce thinning of the thick portion 58 of the compact and thickening of the thin portion 60 of the compact 56. The result in this instance is a flat body 68 (dashed lines) having regions of different magnetic alignment resulting from regions of different plastic flow. In FIG. 7 the arrows depict strain direction rather than magnetization direction. The latter would be perpendicular to the strain as previously stated.

Figure 6A:
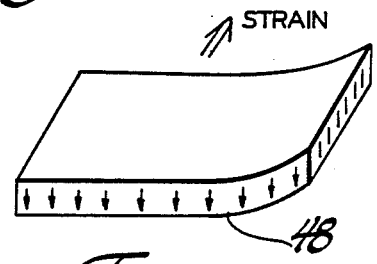
FIGS. 6(*a*) and (*b*) are schematic representations illustrating the making of an arcuate magnet like that depicted in FIG. 5 in accordance with an embodiment of the subject invention.
Figure 6B:
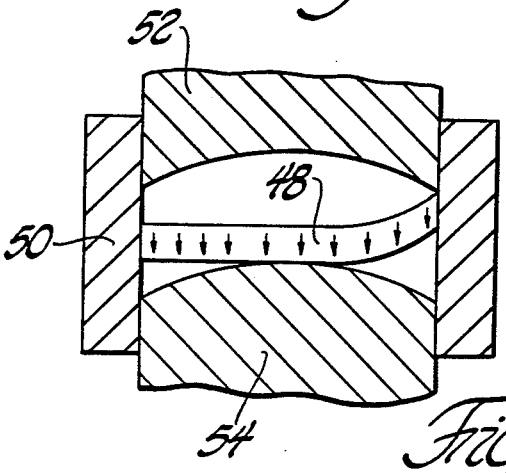

Thus in accordance with our invention, we produce a unitary body of magnetic material that has two or more regions of different magnetic alignment. It is preferred that the regions be separated along a surface direction rather than one region being contained within another. This separation of regions along a surface dimension is illustrated by regions 38 and 40 in arcuate magnet 36 and regions 44 and 46 in arcuate magnet 42. In both cases the regions are separated in the circumferential direction of the arc. The regions of different magnetic alignment are produced by selectively hot working different parts of the body of magnetic material in different ways. Different portions of the body are caused to undergo different degrees of strain at elevated temperature or the strain is induced in different directions. This can be accomplished, for example, by starting with a densified compact of varying thickness and die upsetting it to produce a product of uniform thickness. In another embodiment, a body of magnetic material of uniformly parallel alignment may be bent at elevated temperature (as illustrated in FIG. 6) to produce our two-part magnet structure.

Our invention can also be practiced by using a previously hot pressed compact in combination with particles of melt spun ribbon. By hot working the compact and particles in different regions of the same die, the compact may be die upset (for example) and the particles hot pressed to full density (or nearly full density) with it to form a unitary body having regions of different alignment. In this embodiment one may employ different compositions for the initial compact and for the added particles.

Our practice is particularly useful in making transition metal-rare earth-boron magnets of the type described above. However, it may also be utilized with other magnetic compositions that can be magnetically aligned by plastic deformation at a suitable elevated temperature.

The terms "permanent magnet" or "hard magnet" as used herein mean a material having a significant intrinsic coercivity at room temperture, e.g., greater than 1000 oersted.

While our invention has been described in terms of a few specific embodiments thereof, it will be appreciated that other forms could readily be adapted by one skilled in the art. Accordingly, the scope of our invention is to be limited only by the following claims.

The embodiments of the invention in which an exclusive property or privilege is claimed are defined as follows:

1. A method of making a permanent magnet body comprising first and second regions spaced along a surface dimension of the body that differ in magnetic alignment, the method comprising hot pressing magnetically isotropic particles of a composition comprising iron, neodymium and/or praseodymium, and boron to form a substantially fully densified body of the composition, and hot working the body nonuniformly to produce at least two regions in the body spaced along a surface dimension of it that differ in magnetic alignment.

2. A method as defined in claim 1 in which a said composition comprises, on an atomic basis, 50 to 90 percent of a transition metal taken from the group consisting of iron and mixtures of iron with one or more of cobalt, nickel, chromium and manganese such that iron constitutes at least 60 percent of the total transistion metal content, 10 ot 50 percent rare earth metal where neodymium and/or preaseodymium constitutes at least 60 percent of such rare earth metal, and about 1 to 10 percent boron.

3. A method as defined in claim 2 in which the body is intended for use as an arcuate magnet for a permanent magnet motor and the body is hot worked such that a circumferential edge of the arc has higher apparent coercivity than the central portion of the arc.

4. A method of making a permanent magnet body comprising first and second regions spaced along a surface dimensioned of the body that differe in magnetic alignment, the method comprising hot pressing magnetically isotropic particles of a composition comprising iron, neodymium and/or preaseodymium, and boron and to form a compacted body characterized by a section having at least two portions of different thickness, said composition further comprising, on an atomic basis, 50 to 90 percent of a transition metal taken from the group consisting of iron and mixtures of iron with one or more of cobalt, nickel, chromium and manganese such that iron constitutes at least 60 percent of the total transistion metal content, 10 to 50 percent rare earth metal where neodymium and/or praseodymium constitutes at least 60 percent of such rare earth metal, and about 1 to 10 percent boron, and hot working the body to reduce the thickness of the thicker of the portions and to produce at least two regions in the hot worked body spaced along a surface dimension of it that differ in magnetic alignment.

5. A method of making a permanent magnet body comprising first and second regions spaced along a surface dimension of the body that differ in magnetic alignment, the method comprising hot pressing magnetically istropic particles of a composition comprising iron, neodymium and/or praseodymium, and boron to form a substantially fully densified compact of the composition, introducing the compact and particles of a said composition into a die, and hot pressing the particles and hot working the compact so as to form a unitary body having said first and second regions differing in magnetic alignment.

* * * * *